US005891002A

United States Patent [19]

Maki

[11] Patent Number: 5,891,002

[45] Date of Patent: Apr. 6, 1999

[54] ORTHOPEDIC DEVICE ANKLE EXERCISER AND METHOD

[76] Inventor: Edward L. Maki, 23 S. Victoria, Streamwood, Ill. 60107

[21] Appl. No.: 906,688

[22] Filed: Aug. 5, 1997

[51] Int. Cl.[6] ..... A63B 23/08

[52] U.S. Cl. ..... 482/79; 482/80; 482/146; 482/907; 482/34

[58] Field of Search ..... 482/907, 79, 80, 482/148, 34; 434/258

[56] References Cited

U.S. PATENT DOCUMENTS

| | | | |
|---|---|---|---|
| 735,319 | 8/1903 | Urwick . | |
| 1,989,899 | 2/1935 | Vance . | |
| 2,374,730 | 5/1945 | Catlin . | |
| 2,764,411 | 9/1956 | Washburn, Jr. . | |
| 3,630,540 | 12/1971 | Smith . | |
| 4,337,939 | 7/1982 | Hoyle | 482/79 |
| 4,505,477 | 3/1985 | Wilkinson . | |
| 4,601,469 | 7/1986 | Sasser . | |
| 4,694,684 | 9/1987 | Campbell | 482/80 |
| 4,759,542 | 7/1988 | Hudec . | |
| 4,911,440 | 3/1990 | Hyman | 482/146 |
| 5,328,421 | 7/1994 | Stanalajczo | 482/79 X |
| 5,368,536 | 11/1994 | Stodgell . | |
| 5,487,711 | 1/1996 | Little . | |
| 5,647,830 | 7/1997 | Togau | 482/79 X |

FOREIGN PATENT DOCUMENTS

| | | | |
|---|---|---|---|
| 2439402 | 3/1976 | Germany | 482/79 |

*Primary Examiner*—Richard J. Apley
*Assistant Examiner*—William LaMarca
*Attorney, Agent, or Firm*—Meroni & Meroni

[57] ABSTRACT

An orthopedic device ankle exerciser for rehabilitating and exercising an injured ankle of a pair of feet where each foot has an arch, a heel, toes, and a mid portion and where one foot of the pair of feet has a healthy ankle. The orthopedic device ankle exerciser comprises a foot board, pivot means, and fastening means. The foot board has a central portion, a lower surface, an upper surface opposite the lower surface, a first end, and a second end opposite the first end. The pivot means pivotably and frictionally supports the foot board and the pivot means is fixably and centrally attached to the lower surface of the foot board at the central portion inorder to prevent horizontal translation of the foot board. The fastening means secures the pair of feet to the foot board in selectively fixed side-by-side relation and the fastening means is fixably attached to the upper surface of the foot board proximate the central portion. The fastening means is located and positioned for securing the pair of feet to the foot board so that the arch and the mid portion of each foot overly the pivot means and the central portion and this positioning provides maximum range of movement to the injured ankle. The heel is located in close proximity to the first end and the toes in parallel facing relationship to the second end. The fastening means co-acts with the foot board and therefore enables the healthy ankle to assist the injured ankle to move in upward and downward translation with the pivotal translation of the foot board and the heel of each foot maintains contact with the foot board so as to facilitate active and assisted dorsiflexion and plantar flexion of the injured ankle.

19 Claims, 5 Drawing Sheets

ORTHOPEDIC DEVICE ANKLE EXERCISER AND METHOD

BACKGROUND OF THE INVENTION

1. Field of the Invention

My invention relates to the field of therapeutic rehabilitation devices. In particular, my invention relates to devices facilitating exercise and rehabilitation of the ankle following medical complications or physical injury to the ankle and corresponding muscle groups.

2. Description of the Prior Art

A stroke is a neurological event taking place in the brain of a person that is caused by a lack of blood to the brain. Sometimes a stroke will cause temporary or permanent paralysis of the body's muscle groups. These muscle groups can include the muscle groups of the lower legs and the feet. Often the victim of a stroke will suffer temporary or permanent paralysis of the muscle groups which operate the ankle bones and joints and the victim will sense that the ankle bones and joints have "locked up".

Other physical conditions and diseases will have similar effects on the muscles, bones, and joints of the ankle region of the body. Those physical conditions and diseases include: 1) peripheral vascular disease, a disease which comes with aging and which is caused when the blood vessels in the lower leg fill up with plaque and cause conditions, such as arteriosclerosis and the consequent lack of blood supply to the lower leg, which then causes the inaccurate function of the nervous system and the consequent inability to move the lower leg, 2) nerve injury, and 3) orthopedic injury such as arthritis, muscle sprains, and bone fractures, such as bone spurs.

The ankle joints and muscles are very important for various physical functions such as safe ambulation (walking), stair climbing, and for balancing. The ankle joint is capable of a wide range of motion including dorsiflexion and plantar flexion. Dorsiflexion brings the toes upward and closer to the front of the leg and plantar flexion points the toes downward, curling the sole of the foot under and deepening the arch of the foot. In addition, the ankle muscles, tibialis anterior and the gastrocnemius-soleus unit muscle groups, are critical in the proper functioning of the ankle. The tibialis anterior is an extensor muscle of the anterior compartment of the leg which acts to extend the toes and to produce dorsiflexion. The gastrocnemius-soleus unit muscle groups is a prominent flexor muscle group forming the calf muscles. Together with the Achilles tendon, the gastrocnemius-soleus unit muscle group act to lift the heel and to produce plantar flexion.

Therefore, when injury occurs to the ankle joints and muscles it is imperative to rehabilitate and exercise them, if possible, inorder to restore stability and range of movement, increase strength, and recover neurological capacities so that the victim of the injury can walk again. This is possible by exercising one ankle, if only one ankle has "locked up", or both ankles on a device which is capable of isolating the movement of the ankle or ankles to forward and backward motion and thereby, to pure and isolated dorsiflexion and plantar flexion. In addition, exercising a "good", healthy ankle with a "bad" ankle at the same time will aid rehabilitation of the "bad" ankle.

The prior art devices designed to exercise and rehabilitate ankles can be characterized by different tensioning structures capable of movement in various directions. For example, U.S. Pat. No. 5,368,536 discloses an Ankle Rehabilitation Device that is capable of exercising one ankle at a time in multiple directions. This device discloses a plurality of attachment points extending around the perimeter of the foot receiving platform for providing the various directions of exercise. The device also provides a resistance means and an adjustment means to vary the resistance. However, this device only exercises one ankle at a time, strapped by straps 21, 22, and 23, and does not allow the user to use a "good" ankle and foot to assist the "bad" or "locked up" ankle and foot in the therapy. Moreover, the foot receiving platform is mounted on a ball joint which acts as a pivot to provide the various directions of exercise and the device does not focus solely on pure, isolated dorsiflexion and plantar flexion therapy.

Other prior art devices, such as U.S. Pat. No. 4,601,469 disclose exercise boards mounted on a roller that is secured to the assembly by a retainer pin. The feet of the user are adapted to be placed on opposite sides of the roller so that the user can shift his or her weight from one leg to another to cause the board to pivot on the roller. No straps are used to hold the feet of the user to the board.

Finally, U.S. Pat. No. 2,374,730 discloses an Apparatus For Treatment Of The Feet which is a pair of platforms that are mounted on spring hinge members. Bumpers 36 and 38 are mounted at opposite ends of each pivotal member so that as the foot supports are rocked on their respective spring hinge members, the bumpers can cushion impact with an underlying support frame. The feet are exercised one relative to another by moving the support member on their respective hinge members while each foot is held by individual straps. Again, one "good" foot is not capable of helping the other "bad" foot. In addition, the pivotal member is located at the end of the platform and not underneath the arch of the foot where maximum therapeutic ankle exercise occurs to the ankles' joints and muscles.

Accordingly, it is a principal object of my invention to provide an orthopedic device ankle exerciser that securely straps the feet of the user to the device and thereby isolates ankle exercise and creates pure dorsiflexion and plantar flexion of the ankles as well as strengthens the anterior tibialis and gastrocnemius-soleus unit muscle groups.

It is a further object of my invention to provide an orthopedic device ankle exerciser that re-educates the anterior tibialis and gastrocnemius-soleus unit muscle groups following damage due to strokes, peripheral vascular disease, nerve injury, and orthopedic injury.

It is a further object of my invention to provide an orthopedic device ankle exerciser that provides the means for a "good" ankle to assist the "bad" ankle in pure dorsiflexion and pure plantar flexion exercise as well as to provide the means for one ankle to be exercised at a time, the device being adjustable to any foot size.

It is an additional object of my invention to provide a simple, economical therapeutic orthopedic device ankle exerciser and method of use.

It is an additional object of my invention to provide an orthopedic device ankle exerciser that can be used in either sitting position or standing position and can thereby be used in geriatrics, athletics, and the like.

Other objects of my invention, as well as particular features, elements, and advantages thereof, will be elucidated in, or apparent from, the following description and the accompanying drawing figures.

SUMMARY OF THE INVENTION

According to the features of my invention, I have provided a new and improved orthopedic device ankle exerciser that achieves all of the objects and rehabilitates and exercises ankles of a pair of feet of a user while in sitting position or standing position, each foot having an arch, a heel, toes, a mid portion, and tibialis anterior and gastrocnemius-soleus unit muscle groups, the orthopedic device ankle exerciser comprising: a foot support platform having an upper surface, a lower surface opposite the upper surface, a first end, a second end opposite the first end, a central portion centrally positioned between the first end and the second end, a length and a width; pivot means for pivotably supporting the foot support platform, the pivot means fixably and centrally attached to the lower surface of the foot support platform at the central portion to provide maximum pivotal translation and to prevent horizontal translation of the foot support platform, the pivot means having an axial length running parallel to and substantially covering the width of the foot support platform, the pivot means having an outer diameter substantially smaller than the length of the foot support platform so as to allow upward and downward translation of the first end and the second end of the foot support platform; and foot binding means for binding the pair of feet to the foot support platform in selectively fixed side-by-side relation with the user in the sitting position or the standing position, the foot binding means comprising: an adjustable loop of a thickness defined by a front edge and a rear edge, the adjustable loop being fixably attached to the upper surface of the foot support platform and positioned so that the front edge and the rear edge of the adjustable loop are located between the central portion and the first end of the foot support platform whereby each foot is received through the adjustable loop, the foot binding means being located and positioned on the foot support platform for securing the pair of feet to the foot support platform so that the arch and the mid portion of each foot overly the pivot means and the central portion so as to provide maximum range of movement to the ankles, the heel being located in close proximity to the first end and the toes in parallel facing relationship to the second end, the foot binding means co-acting with the foot support platform enabling the ankles to move in upward and downward translation with the first end and the second end of the foot support platform during pivotal translation of the foot support platform and the heel of each foot maintaining contact with the foot support platform so as to facilitate active and assisted dorsiflexion and plantar flexion of the ankles and to strengthen the tibialis anterior and gastrocnemius-soleus unit muscle groups.

BRIEF DESCRIPTION OF THE DRAWINGS

FIG. I is perspective view of my new and improved orthopedic device ankle exerciser showing foot binding means for a pair of feet, the foot binding means attached to a foot support platform.

DESCRIPTION OF THE PREFERRED EMBODIMENT

Figure 1:
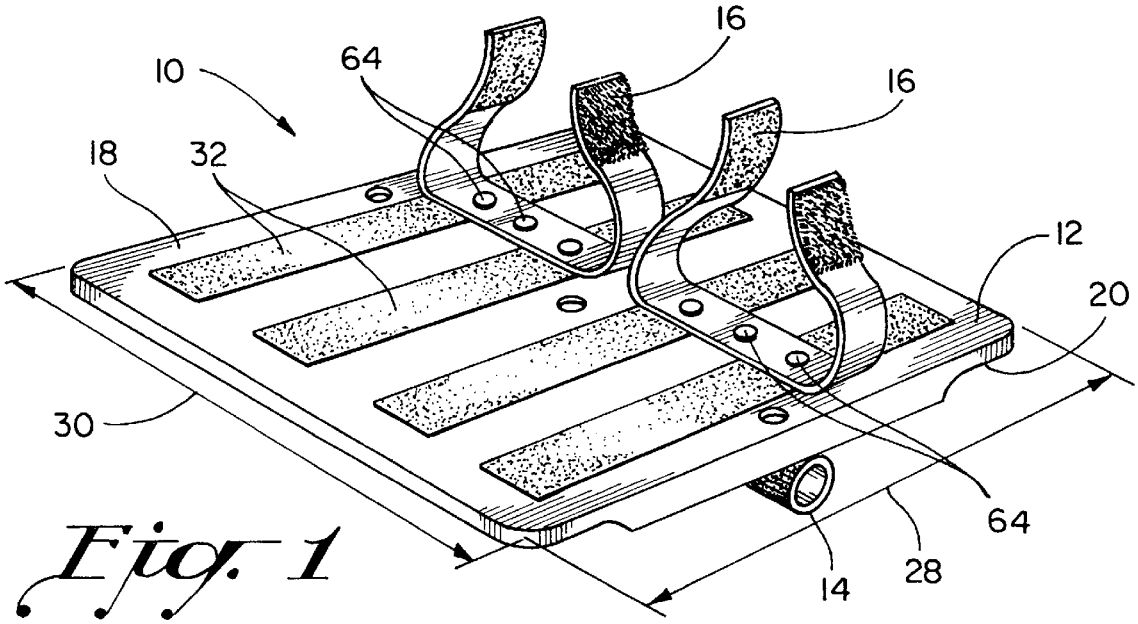
Figure 12:
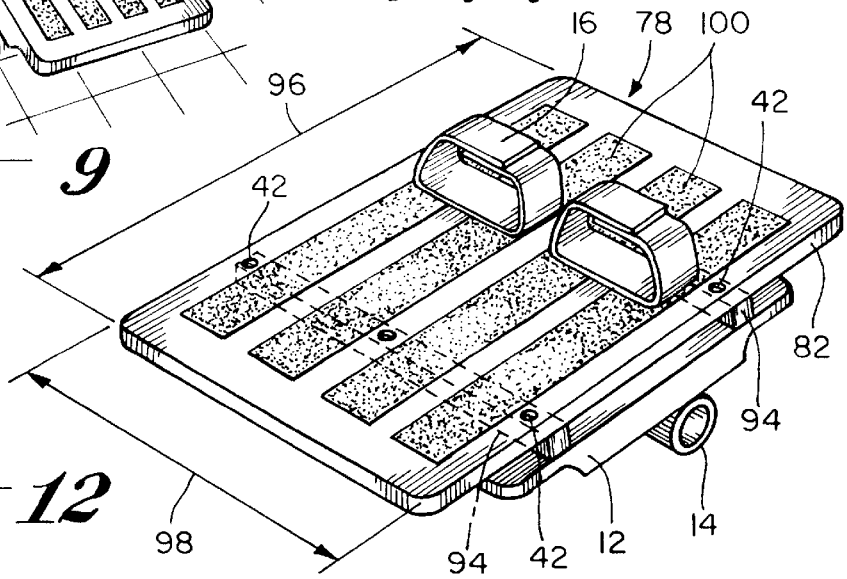
FIG. 12 is a perspective view of my orthopedic device ankle exerciser, the foot binding means used to accomodate an average pair of feet, such as those of a male adult with size 9 feet.

Referring now to the drawings, my invention provides a new and improved orthopedic device ankle exerciser and method for rehabilitating and exercising ankles of a pair of feet as shown in FIG. I as well as a foot platform attachment for use with a pair of feet having above average size as shown in FIG. 12. FIG. 1 shows an embodiment of my invention, the orthopedic device ankle exerciser 10, comprising: a foot support platform 12, a pivot means 14, and a foot binding means 16. In other embodiments, the orthopedic device ankle exerciser 10 is an inclined plane, the foot support platform 12 is a foot board and the foot binding means 16 is a fastening means or a pair of adjustable foot binding straps.

Figure 10:
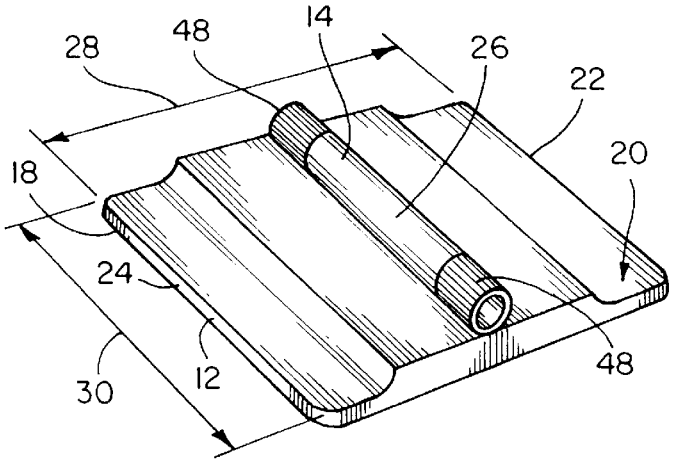
FIG. 10 is a perspective view of the embodiment in FIG. 9 showing the foot binding means attached to a second foot support platform, the second foot support platform attached to a plurality of spacers, the plurality of spacers attached to the foot support platform.

The foot support platform 12 has an upper surface 18, a lower surface 20 as viewed in FIG. 10 with the lower surface 20 being located opposite the upper surface 18, a first end 22, a second end 24 located opposite the first end 22, and a central portion 26 centrally positioned between the first end 22 and the second end 24. The foot support platform 12 has a length 28 and a width 30. The foot support platform 12 can be made of wood, plastic, metal and so forth, and if made of wood, the foot support platform 12 can be protected from wear and tear by wood stain and such.

Figure 2:
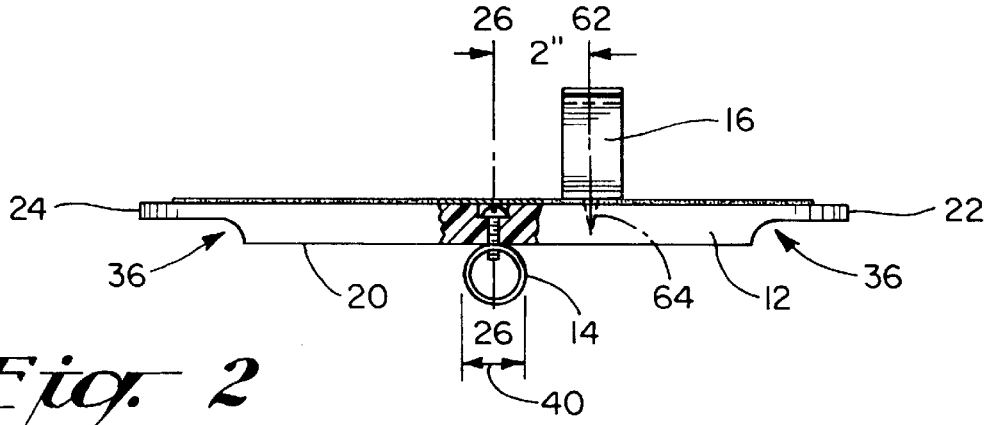
FIG. 2 is a side elevation of my orthopedic device ankle exerciser showing attachment of the foot binding means and pivot means to the foot support platform.
Figure 4:
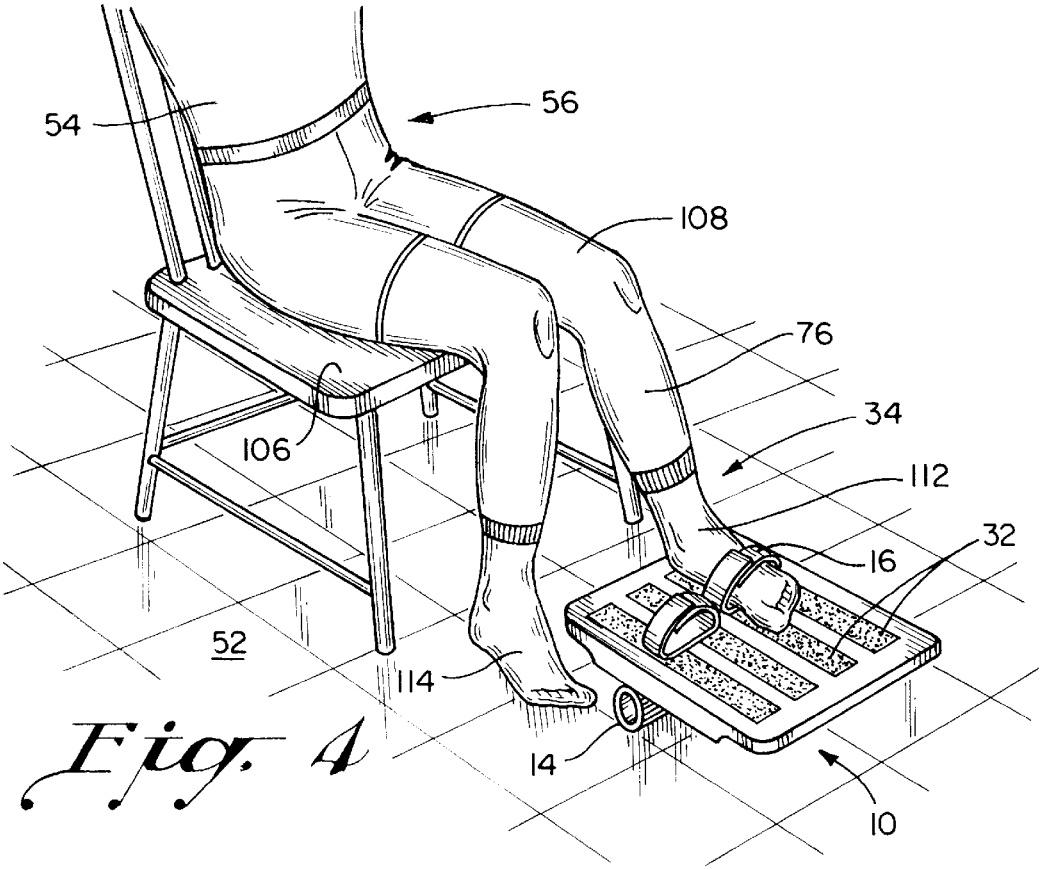
FIG. 4 is a perspective view of my orthopedic device ankle exerciser as used by a user in sitting position to exercise ankles, the user exercising either one or both ankles at a time.

In a preferred embodiment, the length of the foot support platform 12 is 12 inches and the width is 11¼ inches. Furthermore, in the preferred embodiment, the foot support platform 12 comprises: a plurality of friction strips 32 affixed to the upper surface 18 by means of glue, adhesive, and so forth. The plurality of friction strips 32 prevent a pair of feet 34 from slipping during use of the orthopedic device ankle exerciser 10 as shown in FIG. 4. The plurality of friction strips 32 can be four 1 inch width by 10 inch length non slip tape. In addition, in the preferred embodiment as shown in FIG. 2, the first end 22 and the second end 24 of the foot support platform 12 each have a tapered feature 36 inorder to provide maximum upward and downward translation of the foot support platform 12 during usage. The tapered feature 36 can leave a ¼ inch edge remaining at each of the first end 22 and the second end 24.

Figure 3:
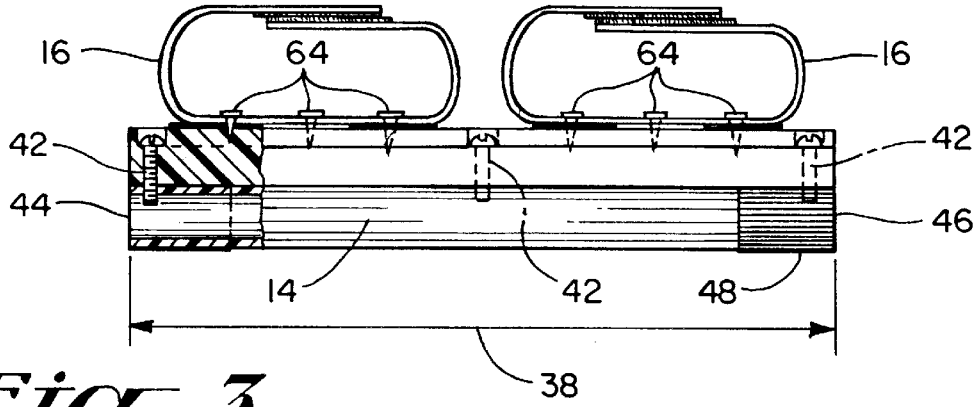
FIG. 3 is a front elevation of my orthopedic device ankle exerciser showing the attachment of the pivot means to the foot support platform.
Figure 6:
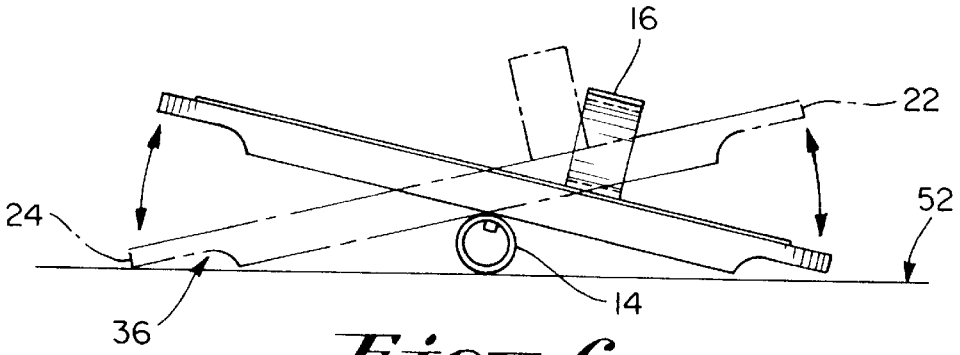
FIG. 6 is a side elevation of my orthopedic device ankle exerciser showing the placement of the pair of feet in the foot binding means, each foot having an arch overlying the pivot means, and consequent dorsiflexion and plantar flexion of the ankles as well as strengthening of tibialis anterior and gastrocnemius-soleus unit muscle groups during pivotal translation.
Figure 8:
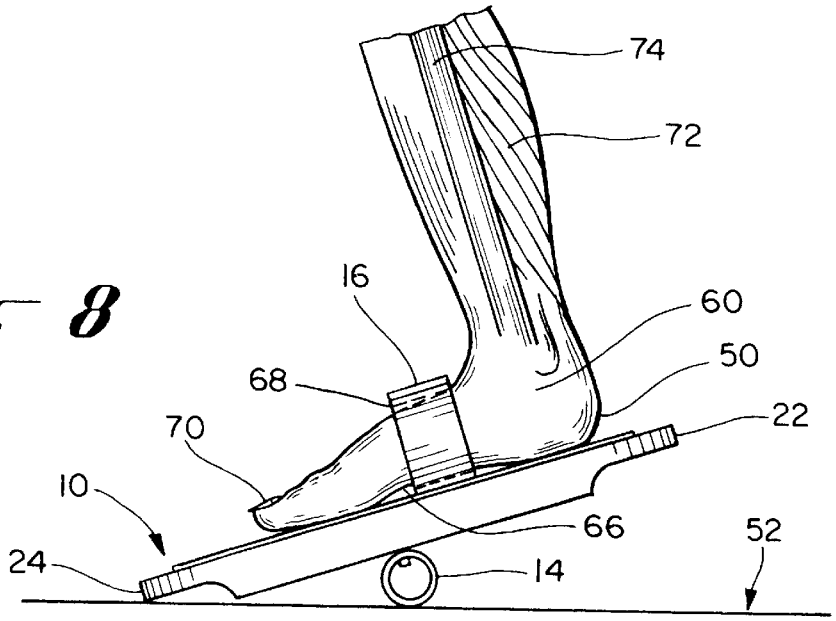
FIG. 8 is a perspective view of my orthopedic device ankle exerciser as viewed upside down to show the foot support platform having a lower surface and the attachment of the pivot means to the lower surface.

The pivot means 14 is designed to pivotably support the foot support platform 12 as shown in FIG. 6. The pivot means 14 is fixably and centrally attached to the lower surface 20 of the foot support platform 12 at the central portion 26 inorder to provide maximum pivotal translation and to prevent horizontal translation of the foot support platform 12 as shown in FIGS. 2, 3, and 8. As shown in FIGS. 2 and 3 the pivot means 14 may be attached to the lower surface 20 by means of machine screw and lock washer combination 42. For example, three ⅝ inch diameter holes are drilled ¼ inch deep through the upper surface 18 and a ¼ inch hole is drilled through the remainder of the foot support platform 12 to the lower surface 20 and then a 13⁄64 inch drill is used to drill a ¼ inch depth into the pivot means 14. Thereafter, a lock washer is placed in each ⅝ inch hole and a ¼ inch 28-tap mountingless or machine screw is placed in each of the three holes to attach the pivot means 14 to the lower surface 20.

The pivot means 14 also has an axial length 38 running parallel to and substantially covering the width 30 of the foot support platform 12 as shown in FIG. 3. In addition, the pivot means 14 has an outer diameter 40 that is substantially smaller than the length 28 of the foot support platform 12 so as to allow upward and downward translation of the first end 22 and the second end 24 of the foot support platform 12 as shown in FIGS. 2 and 6. In the preferred embodiment, as shown in FIG. 2, the outer diameter 40 has a maximum value of 1¼ inches so as to prevent the occurrence of bone of bone fractures, which are extra calcium-type buildups on a heel 50 of each of the pair of feet 34.

Also in the preferred embodiment, as shown in FIGS. 2, 3, and 8, the pivot means 14 is a cylindrical pipe having a first rim 44 and a second rim 46 opposite the first rim 44. The cylindrical pipe can be galvanized and have a length of 10⅞ inches. Furthermore, the first rim 44 and the second rim 46 are each covered by a frictional cover cap 48, as shown in FIGS. 3 and 10, to prevent the pivot means 14 or cylindrical pipe from sliding along a floor surface 52 upon which the cylindrical pipe rests during usage of the orthopedic device ankle exerciser 10. The frictional cover cap 48 can be cylindrical, constructed from materials such as rubber, and can have a length of 2 inches, such as that used on a bike tube.

Figure 9:
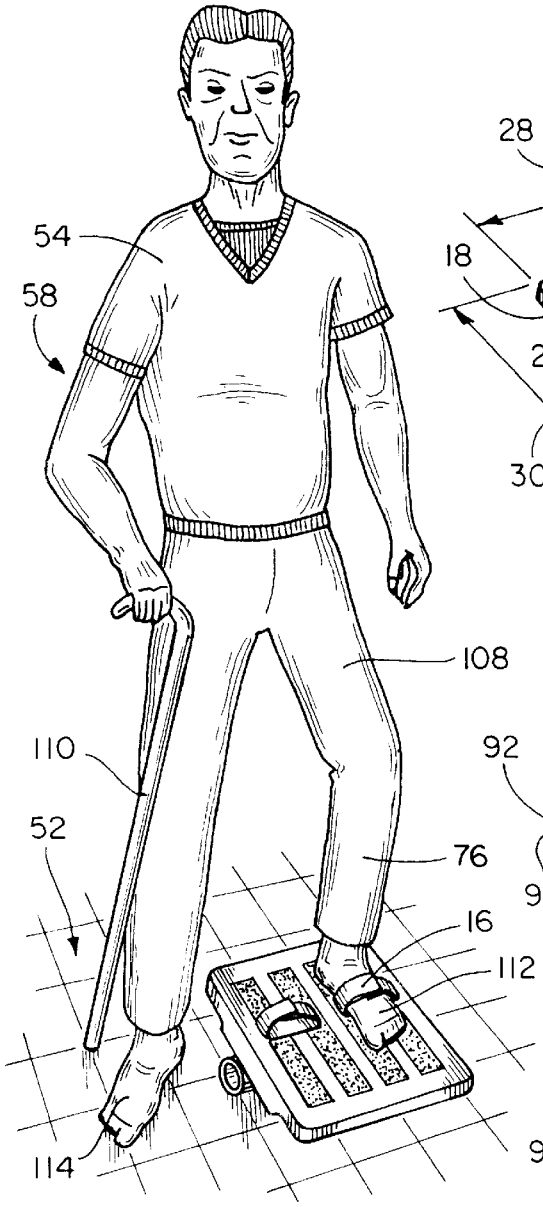
FIG. 9 is a side elevation of another embodiment of my orthopedic device ankle exerciser showing a foot platform attachment to accomodate a pair of feet having above average size.

The foot binding means 16, as shown in FIG. 1, binds the pair of feet 34 to the foot support platform 12 in selectively fixed side-by-side relation with a user 54 in either a sitting position 56 or a standing position 58 as shown in FIGS. 4 and 9 respectively. The foot binding means 16 is fixably attached to the upper surface 18 of the foot support platform 12 and is selectively positioned between the central portion 26 and the first end 22 so as to maximize the exercise of ankles 60 of the pair of feet 34. In the preferred embodiment as shown in FIG. 2, the foot binding means 16 has a center 62 located 2 inches from the central portion 26 so as to provide maximum rehabilitation and exercise to the ankles 60.

Figure 7:
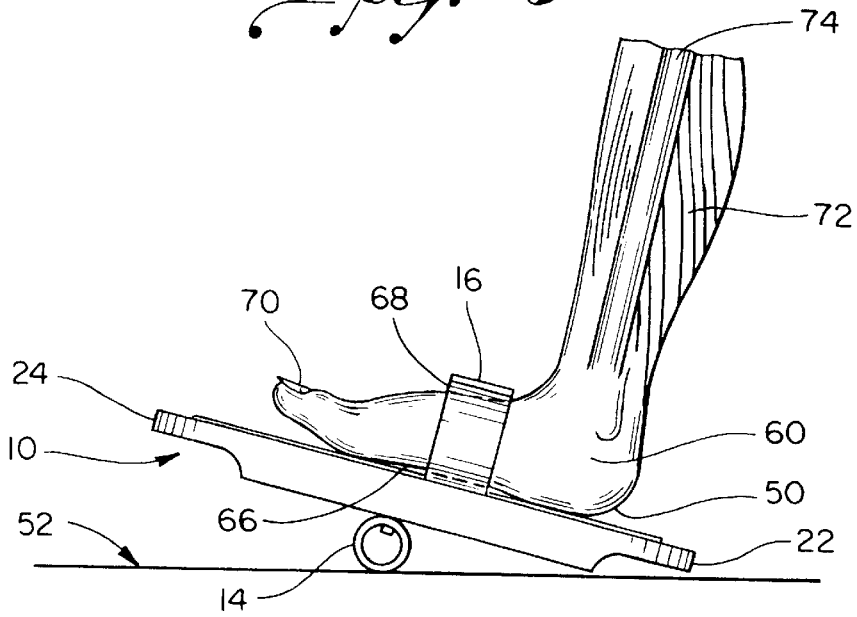
FIG. 7 is a perspective view of my orthopedic device ankle exerciser as used by the user while in standing position and while balancing against a stationary object.

The foot binding means 16, or the pair of adjustable foot binding straps, is located and positioned on the foot support platform 12 for securing the pair of feet 34 to the foot support platform 12 so that an arch 66 and a mid portion 68 of each foot overly the pivot means 14 and the central portion 26 as shown in FIGS. 6–8. This positioning provides maximum range of movement to the ankles 60 and maximum therapeutic value. The heel 50 is also located in close proximity to the first end 22 and toes 70 of each foot of the pair of feet 34 lie in parallel facing relationship to the second end 24. In other words, the heel 50 and the toes 70 lie on opposite sides of the pivot means 14 as shown in FIGS. 4 and 7.

This positioning of each foot of the pair of feet 34 in the foot binding means 16, or pair of adjustable foot binding straps, is crucial because it co-acts with the foot support platform 12 to enable the ankles 60 to move in upward and downward translation with the first end 22 and the second end 24 of the foot support platform 12 during pivotal translation of the foot support platform 12, as demonstrated in FIG. 5–8. The positioning of the foot binding means 16 allows the heel 50 to maintain contact with the foot support platform 12 during the upward and downward translation and thereby allows each foot and the ankles 60 to move in full possible range of movement. The upward and downward translation then facilitates pure and isolated, or active and assisted, dorsiflexion and plantar flexion of the ankles 60 and also strengthens tibialis anterior and gastrocnemius-soleus unit muscle groups 72 of the pair of feet 34 and lower leg members 76 of the user 54 because the ankles are only allowed to move in straight upward and downward translation. FIG. 7 further shows the location of the tibialis anterior and gastrocnemius-soleus unit muscle groups 72 about the bone 74. This same action will help to re-educate the same muscle groups following damage due to strokes, peripheral vascular disease, nerve injury, and orthopedic injury.

The positioning of the foot binding means 16 will keep the pair of feet 34 secure to the foot support platform 12 and thereby create isolated, pure dorsiflexion and plantar flexion of the ankles 60. In the preferred embodiment, as shown in FIGS. 7 and 8, the adjustable nature of the foot binding means 16 will enable the user 54 to place the arch 66 over the pivot means 14 in a comfortably secure manner and the foot binding means 16 will be ideally adjusting for engaging the mid portion 68 inorder to place the arch 66 securely over the pivot means 14 and to allow the heel 50 to maintain contact with the foot support platform 12. The foot binding means 16 will be adjustable to fit any size foot as will be shown below.

Also in the preferred embodiment, the foot binding means 16 is fixably attached to the upper surface 18 by means of attachers 64. The attachers 64 may be roofing nails for a wooden foot support platform 12 or machine screws, such as 6-1032 by ¾ inch flathead machine screws, for a plastic foot support platform 12.

Figure 11:
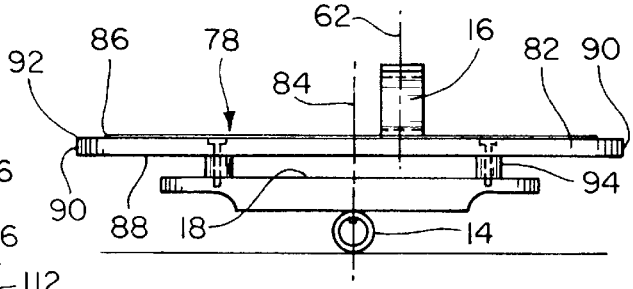
FIG. 11 is a perspective view of my orthopedic device ankle exerciser, the foot binding means used to accomodate a small pair of feet, such as those of a child.
Figure 15:
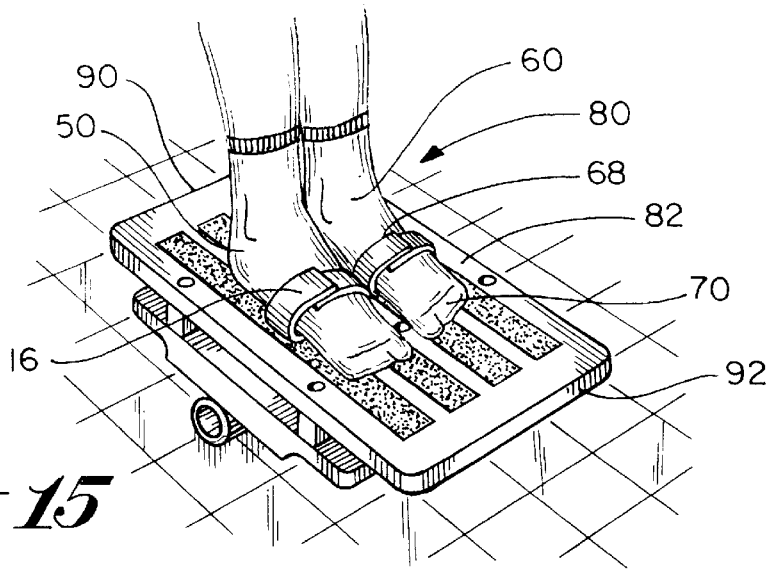

In another embodiment of my orthopedic device ankle exerciser 10, as shown in FIGS. 11, 12 and 15, a foot platform attachment 78 is attached to the upper surface 18 of the foot support platform 12 inorder to accomodate a pair of feet having above average size 80, such as men's size 22 feet. In other embodiments, the foot platform attachment 78 is a foot board attachment.

The foot platform attachment 78, as shown in FIGS. 11 and 12, comprises: a second foot support platform 82 that has a central area 84, an upper surface area 86, a lower surface area 88 located opposite the upper surface area 86, a first edge 90, and a second edge 92 located opposite the first edge 90. In other embodiments, the second foot support platform 82 is a second foot board.

The lower surface area 88 of the second foot support platform 82 is attached to a plurality of spacers 94 which are then attached to the upper surface 18 of the foot support platform 12. In a preferred embodiment of the foot platform attachment 78, the second foot support platform 82 has a lengthwise dimension 96 that is longer than the length 28 of the foot support platform 12 so as to accomodate the pair of feet having above average size 80 and the second foot support platform 82 fits symetrically over the foot support platform 12 and parallel to and flush the length 28 of the foot support platform 12, therefore having a width dimension 98 substantially equivalent to the width 30 of the foot support platform 12. The second foot support platform 82 can be made of wood, plastic, metal and so forth.

Also in the preferred embodiment of the foot platform attachment 78, the plurality of spacers 94 are two boards that are each constructed of 1 inch by 1 inch by 11 inch wood material or the substantial equivalent in dimension and material, as shown in FIGS. 11 and 12. Furthermore, the attachment of the second foot support platform 82 to the plurality of spacers 94 and then to the foot support platform 12 may be made by means of machine screw and lock washer combination 42. For example, three holes may be drilled into the upper surface area 86 of the second foot support platform 82 for each of the plurality of spacers 94 with a ⅝ inch counter sink hole for ¼ inch depth followed by 15/64 inch holes through the remainder to the lower surface area 88, into and through the plurality of spacers 94, and into the foot support platform 12. Then a 3/16 inch flat lock washer is placed into each hole in the upper surface area 88, a "T" nut is placed at the bottom of the 15/64 inch hole, and a 2½ inch by 10–24 HXHD machine screw is screwed down into each hole. This process is repeated for each hole and six holes should be sufficient to anchor the foot platform attachment 78 to the foot support platform 12 by way of the pair of spacers 94.

FIG. 12 also shows a second plurality of friction strips 100 that are affixed to the upper surface area 86 of the second foot support platform 82 inorder to prevent slippage of the pair of feet having above average size 80. The second plurality of friction strips 100 may be affixed by means of glue, adhesive, and so forth. They may be four 1 inch width by 10 inch length non slip tape, though a longer length may be needed to accomodate the pair of feet having above average size 80.

The foot binding means 16, or pair of adjustable foot binding straps, is then fixably attached to the upper surface area 86, as shown in FIGS. 11, 12 and 15, proximate the central area 84 and is located and positioned for securing the pair of feet having above average size 80 to the second foot support platform 82 in selectively fixed side-by-side relation with the user 54 in either the sitting position 56 or the standing position 58. The positioning of the foot binding means 16 on the second foot support platform 82 is so that the arch 66 and the mid portion 68 of each foot of the pair of feet having above average size 80 overly the pivot means 14 and the central area 84 so as to provide maximum range of movement to the ankles 60. The heel 50 of the pair of feet having above average size 80 is located in close proximity the first edge 90, as shown in FIG. 15 and the toes 70 are in parallel facing relationship to the second edge 92. The positioning of the foot binding means 16 allows the heel 50 to maintain contact with the second foot support platform 82 during upward and downward translation and thereby allows each foot of the pair of feet having above average size 80 and the ankles 60 to move in full possible range of movement.

In this manner, the foot binding means 16, or the pair of adjustable foot binding straps, co-acts with the second foot support platform 82 to enable the ankles 60 of the pair of feet having above average size 80 to move in the upward and downward translation with the pivotal translation of the second foot support platform 82 so as to facilitate active and assisted dorsiflexion and plantar flexion of the ankles 60 and to strengthen the tibialis anterior and gastrocnemius-soleus unit muscle groups 72.

In the preferred embodiment of the foot platform attachment 78, the center 62 of the foot binding means 16, or pair of adjustable foot binding straps, is located 2 inches from the central area 84 and the foot binding means 16 is positioned between the central area 84 and the first edge 90 so as to maximize the exercise and rehabilitation of the ankles 60 of the pair of feet having above average size 80. As with the foot support platform 12, the foot binding means 16 may be fixably attached to the upper surface area 86 by means of attachers 64 such as roofing nails or machine screws, as shown in FIG. 11.

Figure 13:
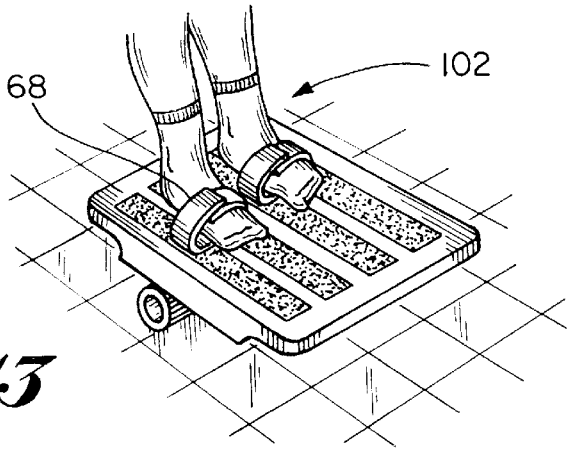
FIG. 13 is a perspective view of the other embodiment of my orthopedic device ankle exerciser, the foot binding means used to accomodate the pair of feet having above average size, such as an athlete's size 22 feet.
Figure 14:
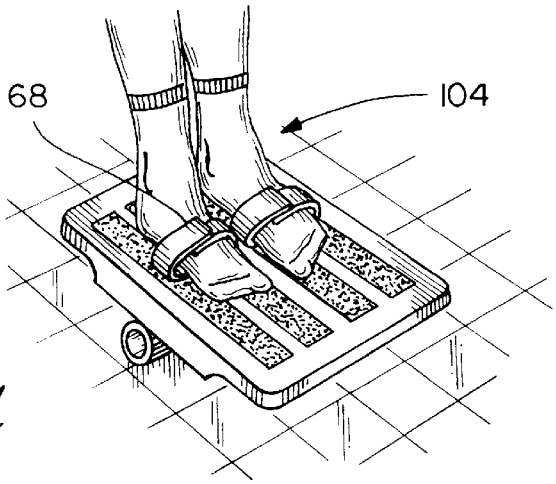

In actual use, my orthopedic device ankle exerciser 10 may be used as is shown in FIGS. 4–9. Furthermore, my orthopedic device ankle exerciser 10 is adaptable to any size foot whether it be a small pair of feet 102, as for a child as shown in FIG. 13, average pair of feet 104, as for an average adult as shown in FIG. 14, or the pair of feet having above average size 80, as shown in FIG. 15.

My orthopedic device ankle exerciser 10 is used in either the sitting position 56 or the standing position 58 and as demonstrated in FIG. 4, 5, and 7–9 is used as follows for any of the three sizes of feet mentioned above and in accordance with the descriptions given above. The user 54 places the orthopedic device ankle exerciser 10, or inclined plane, on the floor surface 52. The user 54 then places the pair of feet 34 on the orthopedic device ankle exerciser 10 with the arch 66 overlying the pivot means 14, the heel 50 proximate the first end 22 (or the first edge 90 for the foot platform attachment 78) and the toes 70 facing the second end 24 (or the second edge 92 for the foot platform attachment 78). The user 54 straps the pair of feet 34 over the mid portion 68, as shown in FIGS. 7 and 8, in adjustably fixed side-by-side relation using the foot binding means 16 so that the pair of feet 34 are secure and yet not too tightly held as to provide discomfort and so that the heel 50 maintains contact with the orthopedic device ankle exerciser 10 throughout the process.

Now, the user 54 rocks the orthopedic device ankle exerciser 10 forward and rearward causing the heel 50 and the toes 70 to move in upward and downward motion thereby facilitating active and assisted dorsiflexion and plantar flexion of the ankles 60 and strengthening the tibialis anterior and gastrocnemius-soleus unit muscle groups 72, as shown in FIGS. 6–8.

Figure 5:
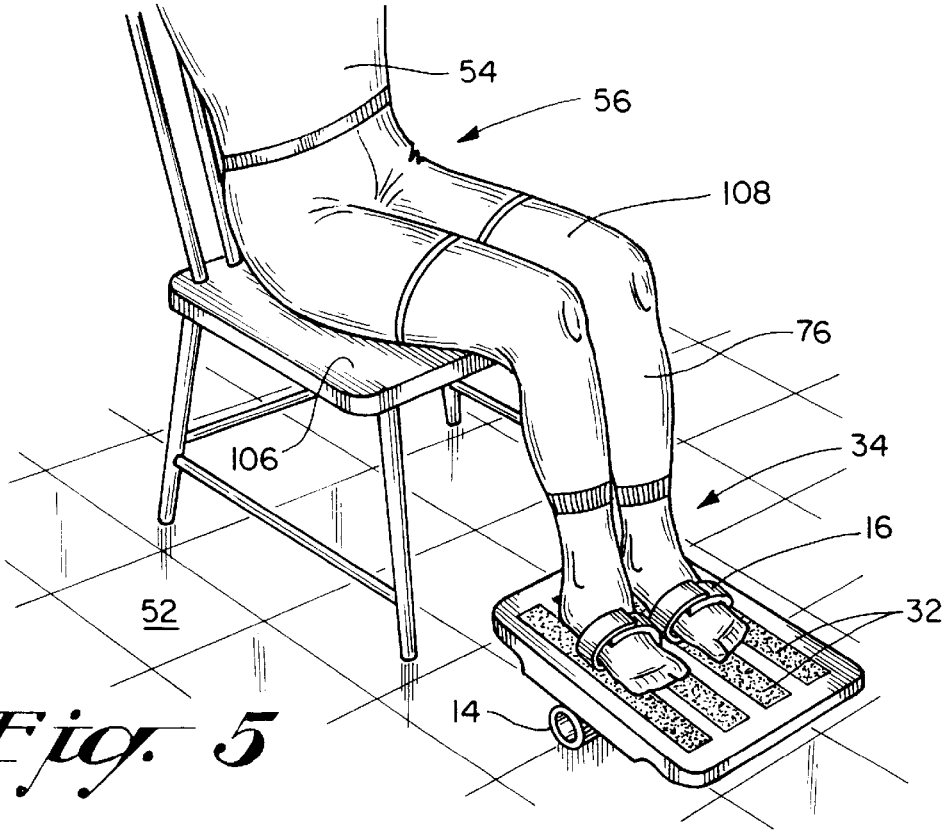
FIG. 5 is a side elevation of my orthopedic device ankle exerciser showing pivotal translation of the foot support platform about the pivot means.

If performed in the sitting position 56 as shown in FIGS. 4–5, the user 54 sits in an object for sitting 106, such as a chair or sofa, and places upper leg members 108 approximately parallel to the floor surface 52 and lower leg members 76 approximately normal to the floor surface 52 inorder to provide maximum pivoting action to the orthopedic device ankle exerciser 10 and maximum dorsiflexion and plantar flexion to the ankles 60.

On the other hand, if the user 54 uses the orthopedic device ankle exerciser 10 in the standing position 58, as shown in FIG. 9, then the user must follow the same procedure described above for using the orthopedic device ankle exerciser 10, except both upper leg members 108 and lower leg members 76 will be substantially normal to the floor surface 52. Therefore, the user 54 will need to grasp or balance himself or herself with a stationary object 110, such as a chair, walker, wall, and so forth inorder to provide balance.

Finally, my orthopedic device ankle exerciser 10 can be used in either the sitting position 56 or the standing position 58 to exercise both ankles 60 of the pair of feet 34 at the same time or one ankle at a time, as shown in FIG. 4. One of the ankles 60 is exercised by placing a first foot 112 on the orthopedic device ankle exerciser 10 and the second foot 114 on the floor surface 52. The ability to exercise both ankles 60 at the same time is very important because when one ankle is "bad" or injured and the other ankle is "good" or healthy, then the user 54 can choose to have the "good" ankle work side-by-side with the "bad" ankle to help exercise and rehabilitate the "bad" ankle. In this way, the damaging effects of strokes and other physical conditions and diseases on the ankle and its muscle groups can be overcome.

While there have been described what are believed to be the preferred embodiments of my present invention, those skilled in the art will recognize that other and further modifications may be made thereto without departing from the spirit of my invention, and it is intended to claim all such changes and modifications that fall within the true scope of my invention.

I claim:

1. An orthopedic device ankle exerciser for rehabilitating and exercising an injured ankle of a pair of feet while in a sitting position or a standing position where each foot has an arch, a heel, toes, a mid portion, and tibialis anterior and gastrocnemius-soleus unit muscle groups and where one foot of the pair of feet has a healthy ankle, the orthopedic device ankle exerciser comprising:

a foot support platform having an upper surface, a lower surface opposite the upper surface, a first end, a second end opposite the first end, a central portion centrally positioned between the first end and the second end, a length and a width;

pivot means for pivotably supporting the foot support platform, the pivot means fixably and centrally attached to the lower surface of the foot support platform at the central portion to provide maximum pivotal translation and to prevent horizontal translation of the foot support platform, the pivot means having an axial length running parallel to and substantially covering the width of the foot support platform, the pivot means having an outer diameter substantially smaller than the length of the foot support platform so as to allow upward and downward translation of the first end and the second end of the foot support platform; and foot binding means for binding the pair of feet to the foot support platform in selectively fixed side-by-side relation while in the sitting position or the standing position, the foot binding means comprising; an adjustable loop of a thickness defined by a front edge and a rear edge, the adjustable loop being fixably attached to the upper surface of the foot support platform and positioned so that the front edge and the rear edge of the adjustable loop are located between the central portion and the first end of the foot support platform whereby each foot is received through the adjustable loop, the foot binding means being located and positioned on the foot support platform for securing the pair of feet to the foot support platform so that the arch and the mid portion of each foot overly the pivot means and the central portion so as to provide maximum range of movement to the injured ankle, the heel being located in close proximity to the first and and the toes in parallel facing relationship to the second end, the foot binding means co-acting with the foot support platform thereby enabling the healthy ankle to assist the injured ankle to move in upward and downward translation with the first end and the second end of the foot support platform during pivotal translation of the foot support platform and the heel of each foot maintaining contact with the foot support platform so as to facilitate active and assisted dorsiflexion and plantar flexion of the injured ankle and to strengthen the tibialis anterior and gastrocnemius-soleus unit muscle groups.

2. The orthodpedic device ankle exerciser of claim 1, the foot support platform further comprising: a plurality of friction strips affixed to the upper surface to prevent slippage of the pair of feet and the first end and the second end of the foot support platform each having a tapered feature to provide maximum upward and downward translation of the foot support platform.

3. The orthopedic device ankle exerciser of claim 2, wherein the pivot means is a cylindrical pipe having a first rim and a second rim opposite the first rim, the first rim and the second rim each covered by a frictional cover cap having a cylindrical shape, the frictional cover cap preventing sliding of the cylindrical pipe along a floor surface.

4. The orthopedic device ankle exerciser of claim 3, wherein the outer diameter of the cylindrical pipe has a maximum size of 1¼ inches so as to prevent the occurrence of bone spurs.

5. The orthopedic device ankle exerciser of claim 3, wherein the foot binding means is a pair of adjustable foot binding straps ideally adjusting for engaging the mid portion of each foot so that the arch of each foot extends over the pivot means, the heel being in close proximity to the first end of the foot support platform and the toes proximately facing the second end of the foot support platform.

6. The orthopedic device ankle exerciser of claim 5, the pair of adjustable foot binding straps further comprising: a center located 2 inches from the central portion of the foot support platform to provide maximum rehabilitation and exercise to the injured ankle.

7. The orthopedic device ankle exerciser of claim 5, further comprising: a foot platform attachment attached to the upper surface of the foot support platform to accommodate a pair of feet having above average size, the foot platform attachment comprising: a second foot support platform having a central area, an upper surface area, a lower surface area opposite the upper surface area, a first edge and a second edge opposite the first edge, the lower surface area attached to a plurality of spacers, the plurality of spacers attached to the tipper surface of the foot support platform, a second plurality of friction strips affixed to the upper surface area of the second foot support platform, the pair of adjustable foot binding straps fixably attached to the upper surface area of the second foot support platform proximate the central area, the pair of adjustable foot binding straps being located and positioned so that the front edge and the rear edge of adjustable loop are located between the central area and the first edge of the second foot support platform whereby each foot is received through the adjustable loop and the pair of feet having above average size are secured to the second foot support platform in selectively fixed side-by-side relation while in the sitting position or the standing position so that the arch and the mid portion of each foot overly the pivot means and the central area so as to provide maximum range of movement and rehabilitation to the injured ankle, the heel being located in close proximity to the first edge and the toes in parallel facing relationship to the second edge, the pair of adjustable foot binding straps co-acting with the second foot support platform thereby enabling the healthy ankle to assist the injured ankle to move in upward and downward translation with the pivotal translation of the second foot support platform and the heel of each foot maintaining contact with the second foot support platform so as to facilitate active and assisted dorsiflexion and plantar flexion of the injured ankle and to strengthen the tibialis anterior and gastrocnemius-soleus unit muscle groups.

8. The orthopedic device ankle exerciser of claim 7, the second foot support platform further comprising: a length dimension greater than the length of the foot support platform to accomodate the pair of feet having above average size and a width dimension substantially equivalent to the width of the foot support platform, the center of the pair of adjustable foot binding straps being located 2 inches from the central area of the second foot support platform and positioned between the central area and the first edge to provide maximum rehabilitation and exercise to the injured ankle.

9. An orthopedic device ankle exerciser for rehabilitating and exercising an injured ankle of a pair of feet where each foot has an arch, a heel, toes, and a mid portion and where one foot of the pair of feet has a healthy ankle, the orthopedic device ankle exerciser comprising:

a foot board having a central portion, a lower surface, an upper surface opposite the lower surface, a first end, and a second end opposite the first end, the foot board further comprising: a plurality of friction strips affixed to the upper surface to prevent slippage of the pair of feet and the first end and the second end each having a tapered feature to provide maximum upward and downward translation of the foot board;

pivot means for pivotably and frictionally supporting the foot board, the pivot means fixably and centrally attached to the lower surface of the foot board at the central portion to prevent horizontal translation of the foot board; and fastening means for securing the pair of feet to the foot board in selectively fixed side-by-side relations the fastening means comprising: an adjustable loop of a thickness defined by a front edge and a rear edge, the adjustable loop being fixably attached to the upper surface of the foot board proximate the central portion so that the front edge and the rear edge of the adjustable loop are located between the central portion and the first end whereby each foot is received through the adjustable loop, the fastening means being located and positioned on the foot board for securing the pair of feet to the foot board so that the arch and the mid portion of each foot overly the pivot means and the central portion so as to provide maximum range of movement to the injured ankle, the heel being located in close proximity to the first end and the toes in parallel facing relationship to the second end, the fastening means co-acting with the foot board thereby enabling the healthy ankle to assist the injured ankle to move in upward and downward translation with the pivotal translation of the foot board and the heel of each foot maintaining contact with the foot board so as to facilitate active and assisted dorsiflexion and plantar flexion of the injured ankle.

10. The orthopedic device ankle exerciser of claim 9, wherein the pivot means is a cylindrical pipe having a first rim and a second rim opposite the first rim, the first rim and the second rim each covered by a frictional cover cap to prevent sliding of the cylindrical pipe along a floor surface.

11. The orthopedic device ankle exerciser of claim 10, the cylindrical pipe further comprising: an outer diameter having a maximum size of 1¼ inches so as to prevent the occurrence of bone spurs.

12. The orthopedic device ankle exerciser of claim 9, wherein the fastening means is a pair of adjustable foot binding straps ideally adjusting for engaging the mid portion of each foot so that the arch of each foot extends over the pivot means, the heel being in close proximity to the first end of the foot board and the toes proximately facing the second end of the foot board.

13. The orthopedic device ankle exerciser of claim 12, the pair of adjustable foot binding straps further comprising: a center located 2 inches from the central portion of the foot board to provide maximum performance of the orthopedic device ankle exerciser.

14. The orthopedic device ankle exerciser of claim 9, further comprising: a foot board attachment attached to the upper surface of the foot board to accommodate a pair of feet having above average size the foot board attachment comprising: a second foot board having a central area, an upper surface area, a lower surface area opposite the upper surface area, a first edge and a second edge opposite the first edge, the lower surface area attached to a plurality or spacers, the plurality of spacers attached to the upper surface of the foot board, a second plurality of friction strips affixed to the upper surface area of the second foot board, the fastening means fixably attached to the upper surface area of the second foot board proximate the central area, the fastening means being located and positioned so that the front edge and the rear edge of the adjustable loop are located between central area and the first edge of the second foot board whereby each foot is received through the adjustable loop and the pair of feet having above average size are secured to the second foot board in selectively fixed side-by-side relation while in a sitting position or a standing position so that the arch and the mid portion of each foot overly the pivot means and the central area so as to provide maximum range of movement to the injured ankle, the heel being located in close proximity to the first edge and the toes in parallel facing relationship to the second edge, the fastening means co-acting with the second foot board thereby enabling the healthy ankle to assist the injured ankle to move in upward and downward translation with the pivotal translation of the second foot board and the heel of each fool maintaining contact with the second foot board so as to facilitate active and assisted dorsiflexion and plantar flexion of the injured ankle.

15. The orthopedic device ankle exerciser of claim 14, the fastening means further comprising: a center located 2 inches from the central area of the second foot board and positioned between the central area and the first edge to provide maximum rehabilitation and exercise to the injured ankle.

16. A method of rehabilitating and exercising an injured ankle of a pair of feet while in a sitting position or a standing position, each foot having an arch, a heel, toes, a mid portion, and tibialis anterior and gastrocnemius-soleus unit muscle groups and where one foot of the pair of feet has a healthy ankle, the method comprising:

providing a foot support platform and a pivot means the foot support platform having a first end, a second end, and a central portion, the second end positioned opposite the first end, the central portion centrally positioned between the first end and the second end, the pivot means fixably and centrally attached to the lower surface of the foot support platform at the central portion, the foot support platform and the pivot means resting on a floor surface;

placing the pair of feet on the foot support platform with the arch overlying the pivot means by receiving each foot through foot binding means comprising an adjustable loop of a thickness defined by a front edge and a rear edge located between the central portion and the first end, the heel proximate the first end of the foot support platform and the toes facing the second end of the the foot support platform;

straping the pair of feet over the mid portion in adjustably fixed side-by-side relation to one another on the foot support platform thereby enabling the healthy ankle to assist the injured ankle in rehabilitation and exercise; and rocking the pair of feet forward and rearward causing the heel and the toes to move in upward and downward motion and the heel maintaining contact with the foot support platform thereby facilitating active and assisted dorsiflexion and plantar flexion of the injured ankle and strenghtening the tibialis anterior and gastrocnemius-soleus unit muscle groups.

17. The method of claim 16, wherein the step of rocking comprises: rocking the pair of feet while in the sitting position on an object for sitting, placing upper leg members approximately parallel to the floor surface and lower leg members approximately normal to the floor surface to provide maximum pivoting action to the foot support platform and maximum dorsiflexion and plantar flexion to the injured ankle.

18. The method of claim 16, wherein the step of rocking comprises: rocking the pair of feet while in the standing position and while grasping a stationary object to provide balance.

19. The method of claim 16, wherein the step of placing comprises: placing a first foot having the injured ankle on the foot support platform and a second foot having the healthy ankle on the floor surface so as to exercise and rehabilitate the injured ankle, straping the first foot over the mid portion in an adjustably fixed manner to the inclined board, rocking the first foot forward and rearward causing the heel and the toes to move in upward and downward motion thereby facilitating active and assisted dorsiflexion and plantar flexion of the injured ankle and strengthening the tibialis anterior and gastrocnemius-soleus unit muscle groups.

* * * * *